US006065921A

United States Patent [19]

Van Dijk

[11] Patent Number: 6,065,921

[45] Date of Patent: May 23, 2000

[54] APPARATUS FOR PARKING AND RETRIEVAL OF A VEHICLE

[75] Inventor: Tjebbe Meindort Van Dijk, De Wijk, Netherlands

[73] Assignee: Designer & Licensee of Products and Projects, Inc., De Wijk, Netherlands

[21] Appl. No.: 09/068,141

[22] PCT Filed: Oct. 30, 1996

[86] PCT No.: PCT/NL96/00426

§ 371 Date: Apr. 29, 1998

§ 102(e) Date: Apr. 29, 1998

[87] PCT Pub. No.: WO97/16613

PCT Pub. Date: May 9, 1997

[30] Foreign Application Priority Data

Nov. 1, 1995 [NL] Netherlands ..... 1001546

[51] Int. Cl.[7] ..... E04H 6/00

[52] U.S. Cl. ..... 414/259; 414/234; 414/253; 414/261; 414/240

[58] Field of Search ..... 414/228, 232, 414/253, 255, 256, 259, 260, 261, 262, 264, 241, 286, 234, 239, 240, 245, 246, 247

[56] References Cited

U.S. PATENT DOCUMENTS

| | | | |
|---|---|---|---|
| 1,828,308 | 10/1931 | Been | 414/239 |
| 2,930,496 | 3/1960 | Wheeler | 414/240 |
| 4,869,634 | 9/1989 | Carter | 414/240 |
| 5,176,484 | 1/1993 | Kuperman et al. | 414/240 |

FOREIGN PATENT DOCUMENTS

| | | | |
|---|---|---|---|
| 0432129 | 6/1991 | European Pat. Off. . | |
| 527013 | 2/1993 | European Pat. Off. | 414/240 |
| 1536359 | 8/1968 | France . | |
| 2266906 | 11/1993 | United Kingdom . | |

*Primary Examiner*—Frank E. Werner
*Attorney, Agent, or Firm*—Webb Ziesenheim Logsdon Orkin & Hanson, P.C.

[57] ABSTRACT

The invention includes a device for parking vehicles for supplying and delivering at an entry/exit position, wherein the device is provided with vertically displaceable lifting devices with which one carrying platform at a time is displaceable in vertical direction. This carrying platform is intended to support a vehicle. The device also includes horizontal transporting devices for taking a platform, which may or may not be loaded with a vehicle, in horizontal direction of the vertical transporting means and carrying it into a parking position.

6 Claims, 6 Drawing Sheets

APPARATUS FOR PARKING AND RETRIEVAL OF A VEHICLE

BACKGROUND OF THE INVENTION

1. Field of the Invention

The invention relates to a method for parking a vehicle, to a method for retrieving a parked vehicle and to a device for parking vehicles for supplying and delivering at an entry/exit position.

2. Description of the Related Art

The parking of vehicles in urban areas is becoming an increasingly acute problem. A common solution is to build multi-storey car parks in which a vehicle can be driven to a parking place. However, these car parks are large in size and a significant part of the volume thereof is laid out as traffic lanes whereby this space cannot be employed as useful parking space. Automatic car parks also exist wherein a vehicle is automatically carried to a parking position by transporting means designed specifically for this purpose. In such a car park a significant part of the available volume is also set out with driving lanes whereby here also the number of parking positions per unit of volume is limited. In addition, automatic car parks entail very costly constructions which are susceptible to breakdown, wherein the waiting times during retrieval of a parked vehicle can be very long.

The French patent FR-A-1536359 discloses a mechanical parking device for cars. The parking device comprises a monorail along which cars are brought to and taken from several parking positions. The parking positions can be on several stores of a building in which lifting means are required. The parking positions can also be on equal level in which case a monorail shunting construction is provided. Also a combination of the parking position configurations as mentioned above is disclosed. A disadvantage of this construction is the complexity of construction which makes the parking device voluminous in relation to the effective volume used for parking positions.

The present invention has for its object to provide an improved method for parking and retrieving a vehicle in addition to a device for parking vehicles for supplying and delivering at an entry/exit position, with which vehicles can be parked and retrieved in relatively simple manner. It is of great importance here with a relatively limited investment to obtain a good ratio of the usefully employed parking volume to the total volume of a parking device.

SUMMARY OF THE INVENTION

The present invention provides for this purpose methods as according to claims 1 and 2. The invention also provides a device for parking vehicles for supplying and delivering at an entry/exit position, comprising:

at least one parking position for a vehicle, a carrying platform associated with each separate parking position for supporting a vehicle, lifting means for vertical displacement of one carrying platform at a time between the entry/exit position and a position contiguous to a parking position, and horizontal transporting means for horizontal displacement of a carrying platform between a position contiguous to the parking position and the parking position, wherein the carrying platform comprises a support frame on which a carrying plate is suspended and the lifting means and the parking position are respectively provided with horizontal guides for receiving the support frame and in which the support frame may be situated.

The methods and device according to the invention make it possible with comparatively very simple means to park vehicles in parking positions which is contiguous to a vertical transport shaft. Use is hereby made in very efficient manner of available space for parking vehicles. The required entry/exit space is also very limited. The entry/exit space of a parking device according to the invention can be embodied in the size of a so-called standardized parking unit. The parking device can be placed above the entry/exit space, can be placed under the entry/exit space (i.e. underground) or it is possible to operate a combined underground and above-ground parking device with the single entry/exit space. These options make the parking device according to the invention very flexible and highly suitable for integration into already existing building developments and infrastructure. The energy costs for the use of such a device can remain very limited on account of the comparatively short transport distances and the hereby limited accelerations the vehicle must undergo.

In a preferred embodiment of the parking device a vertical projection of the parking position on the plane through the entry/exit position contiguous to the entry/exit position. In another preferred embodiment at least two parking positions are located in the same plane which in vertical projection on the plane through the entry/exit position contiguous to the opposite sides of the entry/exit position. These steps minimize the horizontal transporting distance to displace a carrier from the vertical transport shaft to a parking position. This step also optimizes the useful use of space and also optimizes the waiting times for parking and retrieval of a vehicle.

In preference at least two parking positions are located vertically above each other. By providing the parking device with a plurality of storeys the total capacity of a parking device can in principle be extended without limit.

In yet another preferred embodiment of the parking device the lifting means comprise: a frame part, a vertical guide for guiding the frame part, a drive for displacing the frame part vertically along the guide, and coupling means for releasable coupling of the carrying platform to the frame part. Using such a construction both the vertical and horizontal movements can be realized in structurally very simple manner. An additional advantage is that in particular countries a carrying platform with a suspended carrying plate falls under other legislation than a lift construction wherein the carrying plate on which the vehicle stands supports on the vertical guide on the underside of the carrying plate. This enables a less expensive construction.

The device preferably comprises control means for displacing to the entry/exit position a carrying platform with a specific vehicle placed thereon, and displacing a non-loaded carrying platform to the entry/exit position. A user of the parking device can go to the control means and there for instance pull out a parking card. The control means relate the parking card to the carrier and therefore also to the vehicle parked on the carrier. The control means then ensure that the carrying platform with vehicle parked thereon is carried away to a parking position which must be stored in a memory of the control means. When the parking card is fed once again into the control means the control means ensure that the associated platform is displaced from the parking position to the entry/exit position. It is also possible to charge an account of the parking card holder or to request a payment before providing access to the entry/exit position.

The invention also relates to a parking assembly with at least two parking devices, wherein the parking assembly is a modular construction of parking device modules, each parking device module comprises at least all the elements of the parking devices disclosed above.

By means of the modular construction a parking assembly can be combined and/or replaced in very simple manner which is optimal in a specific situation of use. This does not require any further specific costs.

DESCRIPTION OF THE SEVERAL VIEWS OF THE DRAWINGS

The present invention will be further elucidated with reference to the non-limitative embodiments shown in the following figures. Herein.

DETAILED DESCRIPTION OF THE INVENTION

Figure 1:
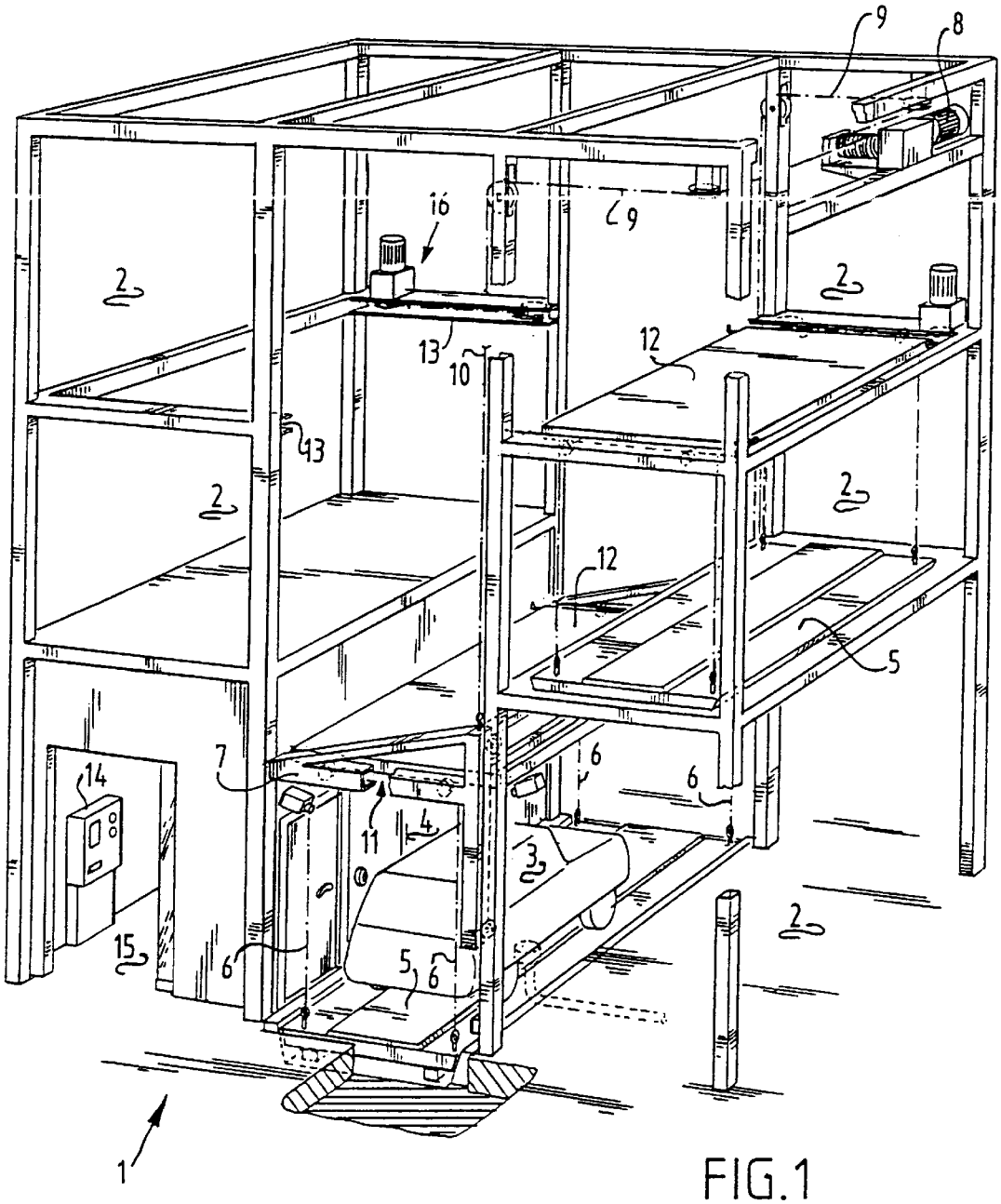
FIG. 1 shows a perspective view of a parking device according to the invention.

FIG. 1 shows a parking device 1 in which five parking positions 2 are arranged. A vehicle 3 is driven into an entry/exit space 4 such that it is placed on a carrying plate 5. This latter is suspended from a frame part 7 using cables or rods 6 (referred to hereinbelow as rods 6). Using a motor 8 and cables 9 the frame part 7 is vertically displaceable along vertical guides 10. Frame part 7 is herein provided with horizontal guides 11. In the horizontal guides 11 of frame part 7 is received a support frame 12 on which the rods 6 of carrying plate 5 engage. That is, support frame 12 is connected to carrying plate 5 by rods 6. By operating the motor 8 the frame part 7 can be displaced in vertical direction such that support frame 12 is contiguous to horizontal guide 13 forming part of a parking position 2. By means of horizontal displacing means 16, which will be further elucidated in FIG. 2, support frame 12 can be displaced out of frame part 7 in horizontal direction until it is situated in the horizontal guide 13 of parking position 2. The carrying plate 5 suspended below support frame 12 and having vehicle 3 resting thereon is then also situated in the parking position 2. For the sake of clarity a carrying plate 5 and a support frame 12 connected thereto by means of rods 6 are shown in this figure only in one parking position 2. It will however be apparent that all parking positions 2 are provided with a support frame 12 with associated carrying plate 5, with the exception of one parking position 2. The support frame 12 with carrying plate 5 forming part of the empty parking position 2 is situated in the entry/exit space 4. As soon as the empty parking position has been filled, and the vehicle 3 is thus situated in the parking position, the frame part 7 can be placed in a position such that it is contiguous to support frame 12 associated with a carrying plate 5 which is empty when a subsequent vehicle must be placed in the parking device 1 or contiguous to a support frame 12 with an associated carrying plate 5 on which a specific vehicle is standing which at that moment must be taken out of the parking device 1. It is noted that access doors (not shown in this figure) are arranged at the front and rear of the entry/exit space 4. The frame part 7 can only be displaced when these doors are closed. It will be apparent that this step has been taken with a view to safety aspects. Also shown in this figure are schematic control means 14 which are located in a space 15 specifically adapted for this purpose. This space 15 is not essential. The control area 15 can also be employed as parking position 2. It is possible to embody the parking device 1 in modular form, wherein a parking device module consists for instance of two layers, i.e. it then has only two storeys instead of the three storeys shown in this figure.

Figure 2:
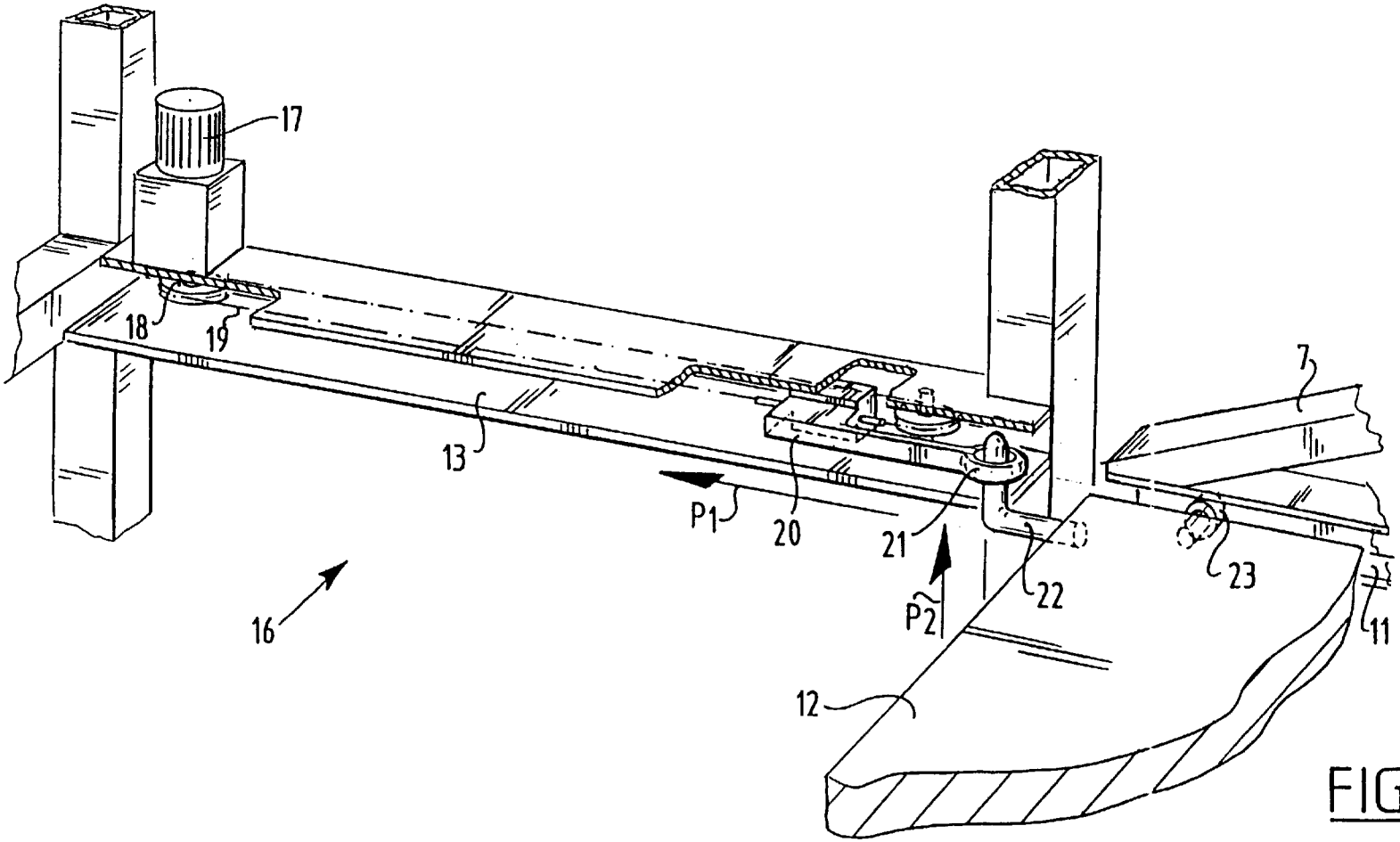
FIG. 2 shows a perspective view of horizontal transporting means according to the invention.

FIG. 2 shows the horizontal displacing means 16, wherein a motor 17 drives a pulley 18 whereby a rope, chain or belt 19 runs. A spindle construction can also be employed for this purpose. The hook 22 as shown in this figure is directed upward, which means that it can co-act with an eye 21 mounted on a support frame 12 forming part of a parking position 2 which is located above entry/exit space 4. A hook 22 which can co-act with a support frame 12 forming part of a parking position 2 located beneath entry/exit space 4 must protrude downward. For simple assembly of a parking device 1 it is possible to opt for a T-shaped embodiment of the hook 22 so that this can be used for any support frame 12 irrespective of the position at which this support frame 12 is arranged in a parking device 1. Fixed onto the rope 19 is a hook 20 with an eye 21. By rotating the pulley 18 the hook 20 can be moved rearward according to arrow P1 from the position shown here. A support frame 12 is first of all carried as according to arrow P2 to the correct height such that the horizontal guide 11 in frame part 7 connects onto the horizontal guide 13 of the parking position 2. When the two horizontal guides 11,13 are fully connected up to each other a hook 22, which hook 22 is rigidly connected to support frame 12, will also fall into the eye 21 of the hook 20 of the horizontal displacing means 16. By moving the hook 20 of the horizontal displacing means 16 as according to arrow P1 the support frame 12 will be pulled along and the rollers 23 with which support frame 12 is displaceable in horizontal guide 11 will move across into horizontal guide 13 of parking position 2. Support frame 12 and the carrying plate 5 suspended thereon can thus be displaced in horizontal direction. It will be apparent that for the opposite effect the hook 20 of the horizontal displacing means must be displaced from a position close to the pulley 18 in a direction opposite to that of arrow P1.

Figure 3:
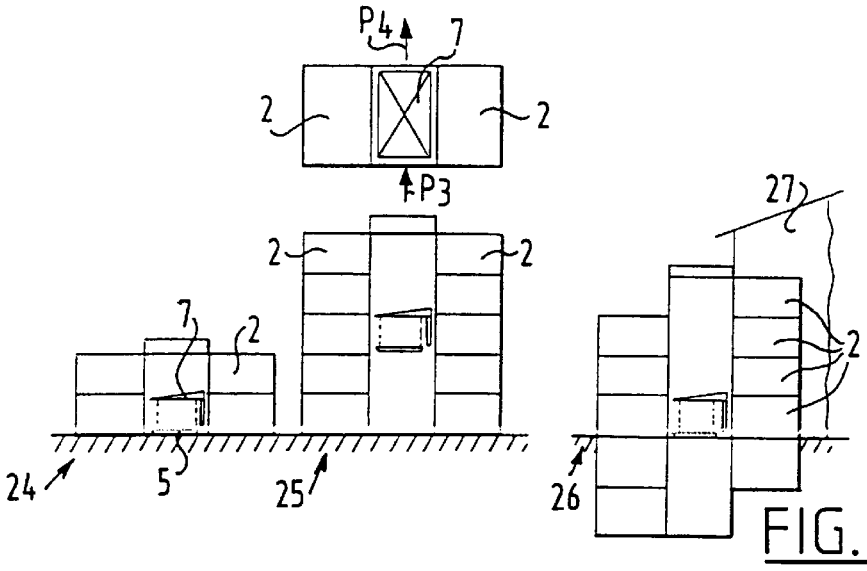
FIG. 3 shows several side views and a top view of a number of alternative parking devices according to the invention.

FIG. 3 shows a first parking device 24 of the type as shown in FIG. 1 of two storeys located above ground. Such a parking device 24 can consist for instance of a single parking device module. The parking device 25 has five storeys located above ground. In top elevation it is apparent that the parking positions 2 is contiguous to two sides of the vertical transporting column in which the frame part 7 is displaceable. Supply of a vehicle can take place according to arrow P3 while delivery of the parked vehicle is possible as according to arrow P4. Finally, FIG. 3 shows a parking device 26 in which one and a half storeys of the parking device 26 are arranged underground and three and a half storeys are situated above ground. It is also noted here that four parking positions 2 are located in a building 27.

Figure 4:
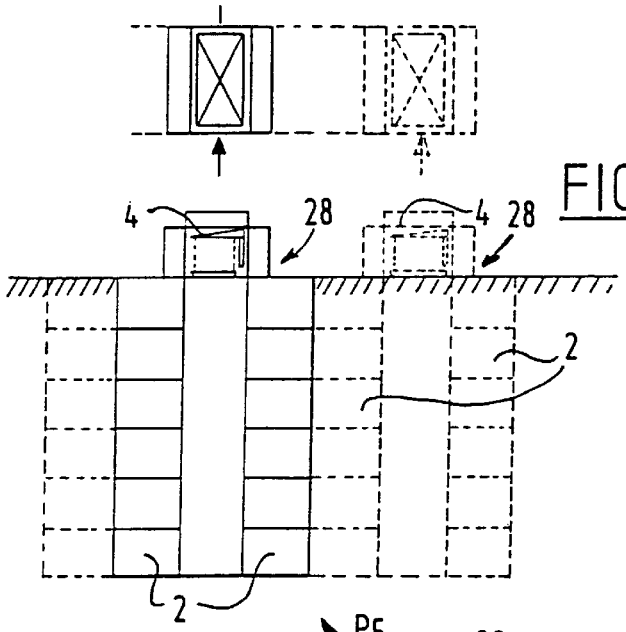
FIG. 4 shows a side view of a combination of two parking devices according to the invention.

FIG. 4 shows a combination of two underground parking devices 28. The entry/exit spaces 4 of parking devices 28 are located above ground at some distance apart. The underground parking positions 2 of parking devices 28 are mutually contiguous. Such a combination has the advantage that the parking capacity, particularly at peak loads, can be embodied sufficiently large so that waiting times can remain limited.

Figure 5:
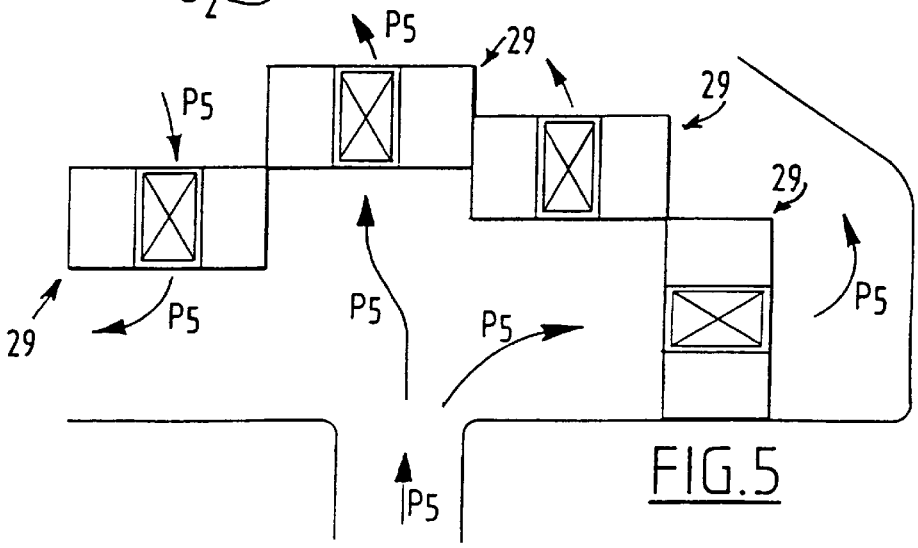
FIG. 5 shows a top view of a combination of four parking devices according to the invention.
Figure 6:
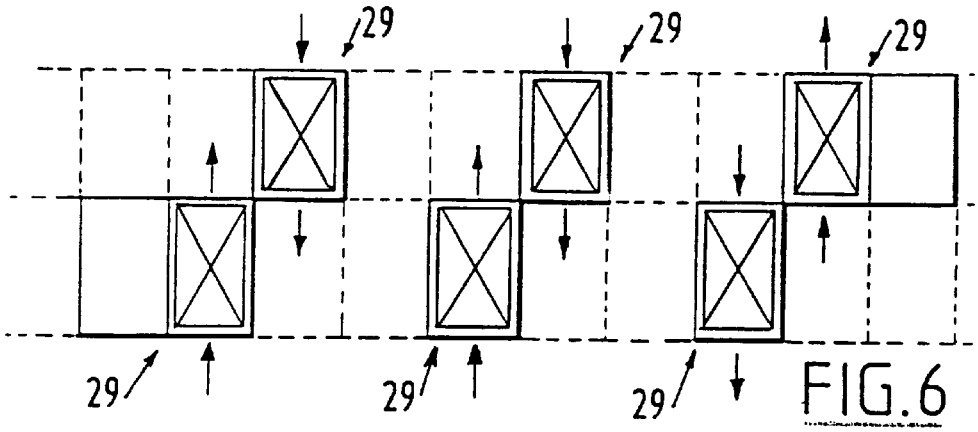
FIG. 6 shows a top view of an alternative combination of six parking devices according to the invention.

FIG. 5 shows a top view of a combination of four parking devices 29 with which a circulation of vehicles can be created as required, such as indicated for instance by the arrows P5. It should however be apparent that the placing of parking devices 29 provides very many options and can be optimized in accordance with the specific mode of use. Another example hereof is shown in FIG. 6, wherein parking devices 29 connect onto each other in both transverse and lengthwise direction. When the parking combination comprises a plurality of accesses, maintenance can be carried out on a part of the combination while the parts not being serviced can remain in operation.

Figure 7:
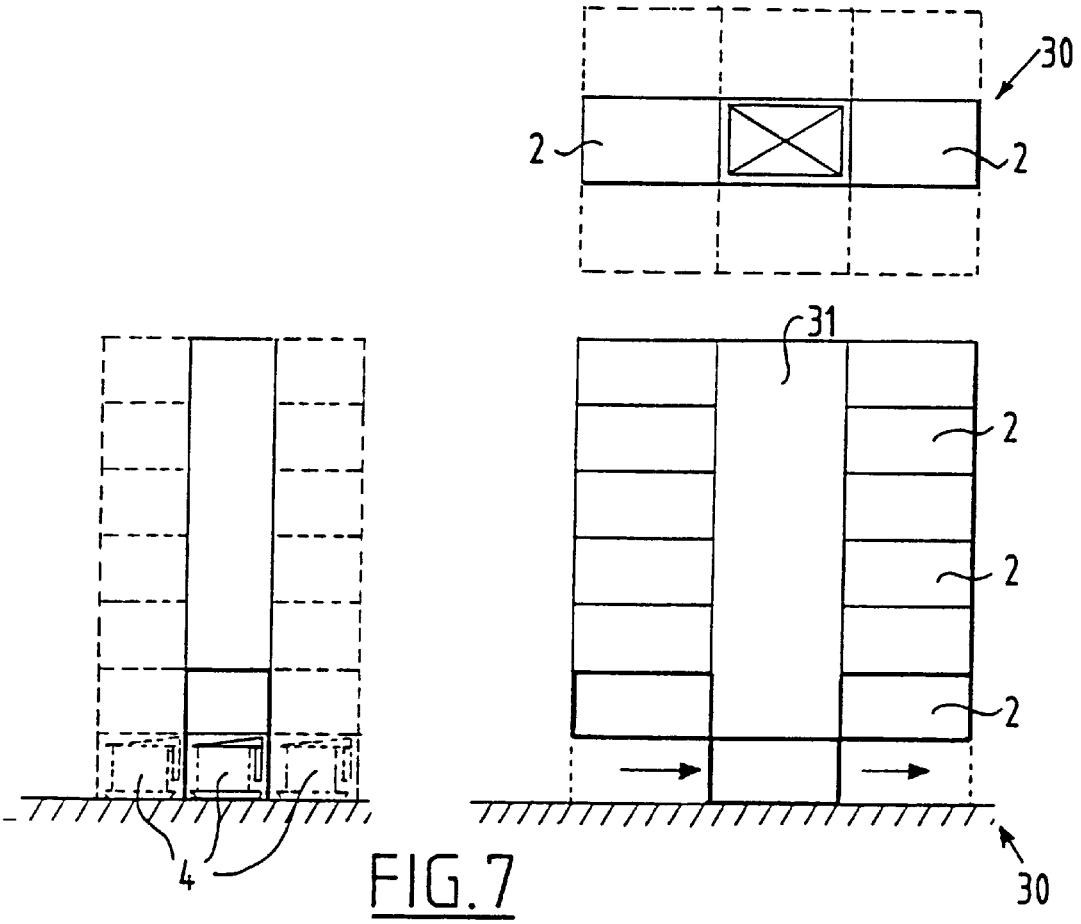
FIG. 7 shows two side views and a top view of another alternative combination of three parking devices according to the invention.

FIG. 7 shows an alternatively embodied parking device 30, wherein the parking positions 2 is contiguous to the short side of vertical transporting column 31. When three parking devices 30 are placed contiguously, the entry/exit spaces will thus also be mutually contiguous.

Figure 8:
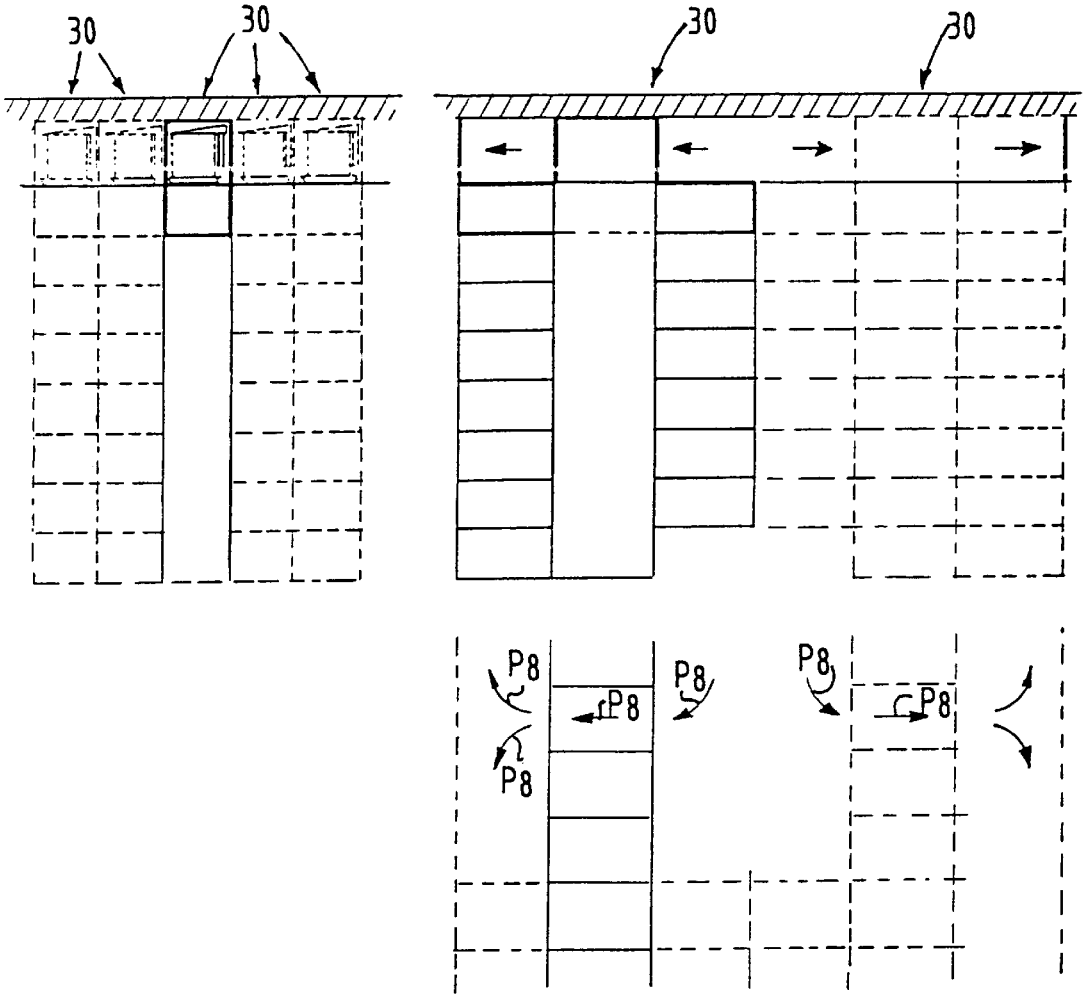
FIG. 8 shows yet another alternative combination of a number of parking devices according to the invention.

A completely underground variant of a combination of parking devices 30 is shown in FIG. 8. Also shown here in side view is that parking devices 30 can also connect onto each other in lengthwise direction, so that a vehicle circulation can be realized for instance as according to the arrows P8.

Figure 9:
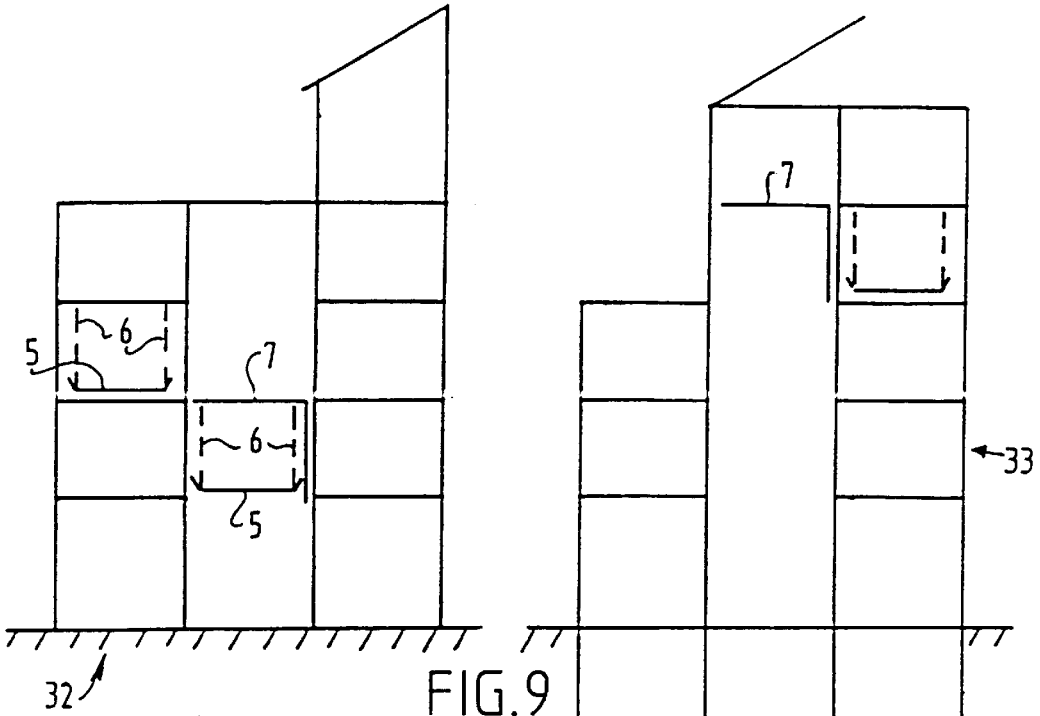
FIG. 9 shows a side view of two different parking devices according to the invention.

FIG. 9 shows a schematic side view of a parking device 32 which shows schematically the situation where a carrying plate 5 is suspended from a frame part 7 by means of rods 6. The parking position 2 is also shown in the situation where a carrying plate 5 suspended from rods 6 is situated therein. In the normal operating situation all parking positions 2 will be provided with such a carrying plate 5. It may also be that one parking position 2 is not provided with a carrying plate 5 since this latter is then suspended from frame part 7 as can be seen in FIG. 9.

Another alternative embodiment is also shown in FIG. 9, wherein an aboveground part 33 of a parking device 34 is provided with a vertically displaceable frame part 7 and an underground part 35 of parking device 34 is likewise provided with a vertically displaceable frame part 7. It is stated emphatically here that the control of the frame parts 7 must be embodied such that the frame parts 7 are prevented from coming into mutual contact. The advantage of two frame parts 7 is that the device 34 can put away and deliver vehicles relatively more quickly.

Figure 10:
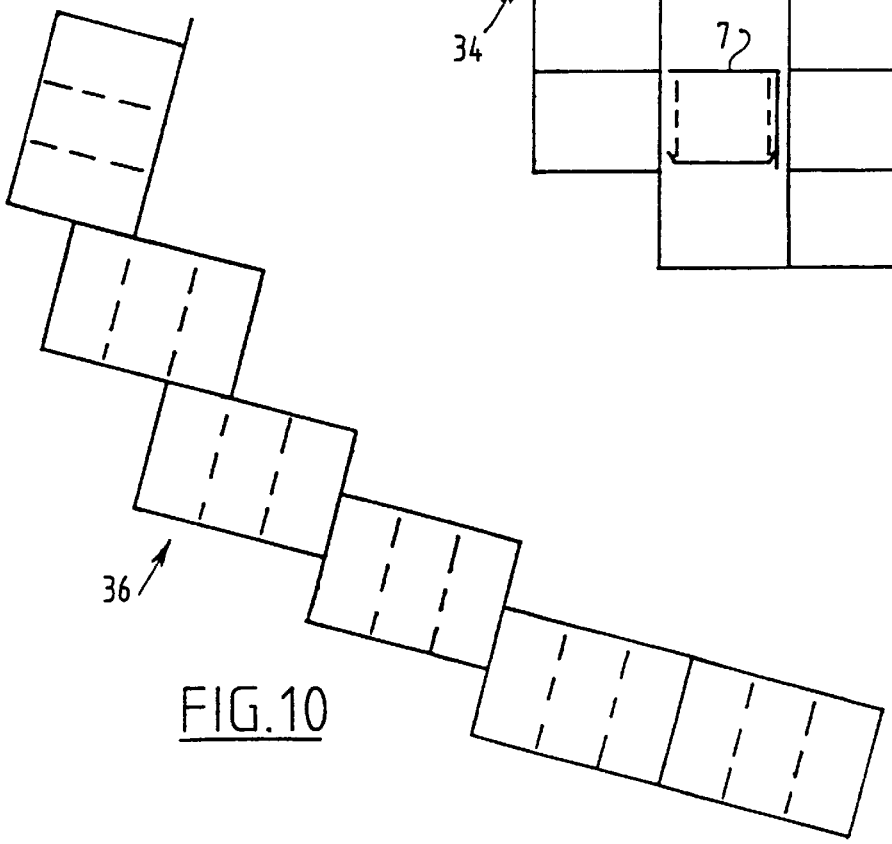
FIG. 10 shows a top view of yet another combination of six parking devices according to the invention.

Finally, FIG. 10 shows yet another configuration 36 of six parking devices.

What is claimed is:

1. A device for moving vehicles to parking positions in a structure from a common entry/exit position, comprising:

a) at least one parking position within the structure, wherein each parking position is for one vehicle and wherein each parking position has spaced horizontal guides, b) a carrying platform associated with each separate parking position for supporting one vehicle, wherein the carrying platform comprises a support frame on which a carrying plate is suspended and wherein the carrying plate has spaced horizontal guides, c) lifting means associated with the structure for vertical displacement of one carrying platform at a time between the entry/exit position and a position contiguous to a parking position, wherein the lifting means has spaced horizontal guides, d) horizontal transporting means associated with the structure for horizontal displacement of the carrying platform between the position contiguous to the parking position and the parking position, and e) wherein the horizontal guides of the lifting means and the parking position are mateable with and receive the horizontal guides of the support frame and wherein the horizontal guides of the support frame may be situated within the horizontal guides of the lifting means and of the parking position.

2. The device for parking vehicles as claimed in claim 1, wherein i) a vertical projection of the at least one parking position defines a first vertical column, ii) a vertical projection of the entry/exit position defines a second vertical column, and iii) the first vertical column is contiguous with the second vertical column.

3. The device as claimed in claim 1, wherein i) a vertical projection of a first parking position defines a first vertical column, ii) a vertical projection of a second parking position defines a second vertical column, iii) a vertical projection of the entry/exit position defines a third vertical column, and iv) wherein both the first vertical column and the second vertical column are contiguous with and on opposite sides of the third vertical column.

4. The device as claimed in claim 1, wherein at least two parking positions are located vertically above each other.

5. The device as claimed in claim 1, wherein the lifting means comprises:

i) a frame part, ii) a vertical guide for guiding the frame part, iii) a drive for displacing the frame part vertically along the guide, and iv) coupling means for releasable coupling of the carrying platform to the frame part.

6. A parking assembly with at least two parking devices, wherein the assembly is a modular construction of parking device modules, each parking device module comprises:

a) at least one parking position within a structure, wherein each parking position is for one vehicle and wherein each parking position has spaced horizontal guides, b) a carrying platform associated with each separate parking position for supporting one vehicle, wherein the carrying platform comprises a support frame on which a carrying plate is suspended and wherein the carrying plate has spaced horizontal guides, c) lifting means associated with the structure for vertical displacement of one carrying platform at a time between an entry/exit position and a position contiguous to a parking position, wherein the lifting means has spaced horizontal guides, d) horizontal transporting means associated with the structure for horizontal displacement of the carrying platform between the position contiguous to the parking position and the parking position, and e) wherein the horizontal guides of the lifting means and the parking position are mateable with and receive the horizontal guides of the support frame and wherein the horizontal guides of the support frame may be situated within the horizontal guides of the lifting means and of the parking position.

* * * * *